US005153114A

United States Patent [19]

Kaneko et al.

[11] Patent Number: 5,153,114

[45] Date of Patent: Oct. 6, 1992

[54] SILVER HALIDE PHOTOGRAPHIC LIGHTSENSITIVE ELEAGENT CONTAINING AN ANTI-HALATION DYE

[75] Inventors: Satoshi Kaneko; Akira Tanaka, both of Nagaokakyo, Japan

[73] Assignee: Mitsubishi Paper Mills, Ltd., Tokyo, Japan

[21] Appl. No.: 740,571

[22] Filed: Aug. 6, 1991

[30] Foreign Application Priority Data

Aug. 8, 1990 [JP] Japan ..... 2-209588

[51] Int. Cl.[5] ..... G03C 1/06

[52] U.S. Cl. ..... 430/522; 430/510; 430/517; 430/592

[58] Field of Search ..... 430/510, 517, 522, 592, 430/593, 595

[56] References Cited

U.S. PATENT DOCUMENTS

| | | | |
|---|---|---|---|
| Re. 29,168 | 4/1977 | Heseltine et al. | 430/522 |
| 3,758,309 | 9/1973 | Bailey et al. | 430/522 |
| 3,840,375 | 10/1974 | Sauter | 450/522 |
| 4,882,265 | 11/1989 | Laganis et al. | 430/522 |
| 4,940,578 | 2/1990 | Tanaka et al. | 430/529 |
| 4,980,276 | 12/1990 | Arai et al. | 430/522 |

*Primary Examiner*—Jack P. Brammer

*Attorney, Agent, or Firm*—Cushman, Darby & Cushman

[57] ABSTRACT

Disclosed is a silver halide photographic lightsensitive material which comprises a support and at least one hydrophilic colloid layer including a silver halide emulsion layer, said hydrophilic colloid layer layer containing at least one dye represented by the following formula (I):

(I)

(where $R_1$ represents an alkyl group, $R_2$ represents an alkyl group or an aryl group, Y represents a group of atoms necessary to form a saturated hydrocarbon ring or a saturated heterocyclic ring together with the carbon atom on the 3 position of pyrrole ring having Z, Z represents a group of atoms necessary to form a benzo condensed ring or a naphtho condensed ring, n represents 1 or 2, m represent 1 or 2 and m is 1 when the dye forms an inner salt, and X⊖ represents an anion, with a proviso that a molecule of the dye has at least one acid substituent.

6 Claims, No Drawings

SILVER HALIDE PHOTOGRAPHIC LIGHTSENSITIVE ELEAGENT CONTAINING AN ANTI-HALATION DYE

BACKGROUND OF THE INVENTION

The present invention relates to a silver halide photographic lightsensitive material and more particularly to a silver halide photographic lightsensitive material having a dyed hydrophilic colloid layer.

The photographic emulsion layer or other layers of silver halide photographic lightsensitive materials are often colored for absorbing a light in a specific wavelength region.

When it is necessary to control spectral composition of light which is to enter the photographic layer, a colored layer is provided at the position more distant than the photographic emulsion layer from the support on a photographic lightsensitive material. Such colored layer is called a filter layer.

When a plurality of photographic emulsion layers are present as in multilayer color lightsensitive materials, the filter layer can be provided in the middle position of them.

Furthermore, a colored layer is provided between the photographic emulsion layer and the support or on the side of the support where the photographic emulsion layer is not provided for inhibiting blur of image, namely, halation caused by light reflected back into the photographic emulsion layer from interface between the emulsion layer and the support or from the surface of the photographic material opposite to the surface on which the emulsion layer is not provided which has been scattered during or after transmitting through the photographic emulsion layer.

Such colored layer is called an antihalation layer. When a plurality of photographic emulsion layers are provided as in multilayer color lightsensitive materials, the antihalation layer may be provided therebetween.

It is also carried out to color the photographic emulsion layer for prevention of reduction in sharpness of image due to scattering of light in the photographic emulsion layer (a phenomenon generally called irradiation).

In many cases, these layers to be colored comprise hydrophilic colloid and hence, water-soluble dyes are contained in the layers for coloration.

The dyes must satisfy the following conditions.

(1) They have proper spectral absorption depending on purposes of use.

(2) They have a high absorbance.

(3) They are photographic chemically inert, namely, have no adverse effect in chemical sense on the properties of the silver halide photographic emulsion layer, for example, reduction of sensitivity, fading of the latent image, and fogging.

(4) They cause no change with time such as discoloration during preparation of coating composition (for photographic emulsion), preparation of emulsion and storage.

(5) They do not cause failure in coating due to increase in viscosity when they are added to coating compositions (for photographic emulsion).

(6) They are decolored or dissolved away in the course of photographic processing and leave no harmful color on the photographic lightsensitive material after processed.

Hitherto, many dyes which absorb visible light or ultraviolet light have been proposed for satisfying these conditions, but only a few of them satisfy the above conditions.

SUMMARY OF THE INVENTION

Accordingly, the object of the present invention is to provide a silver halide photographic lightsensitive material which has a hydrophilic colloid layer colored with a water-soluble photographic light absorbing dye which satisfies the above conditions (1)-(6) and has excellent anti-irradiation and anti-halation effects and filter effect.

DESCRIPTION OF THE INVENTION

As a result of intensive research conducted by the inventors on water-soluble dyes, it has been found that the object has been attained by a silver halide photographic lightsensitive material, characterized by having a hydrophilic colloid layer containing at least one dye represented by the following formula (I):

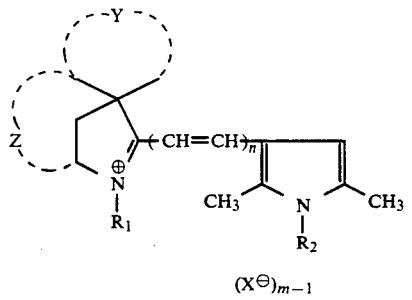

(I)

(wherein $R_1$ represents an alkyl group, $R_2$ represents an alkyl group or an aryl group, Y represents a group of atoms necessary to form a saturated hydrocarbon ring or a saturated heterocyclic ring together with the carbon atom on the 3-position of pyrrole ring having Z, Z represents a group of atoms necessary to form a benzo condensed ring or a naphtho condensed ring, n represents 1 or 2, m represents 1 or 2 and m is 1 when the dye forms an inner salt, and $X\ominus$ represents an anion, with a proviso that a molecule of the dye has at least one acid substituent).

The alkyl groups represented by $R_1$ are preferably lower alkyl groups of 1-5 carbon atoms (for example, methyl, ethyl, n-propyl, isopropyl, n-butyl and isoamyl) and these may have substituents (for example, sulfo group, carboxy group and hydroxy group). More preferred are lower alkyl groups of 1-5 carbon atoms which have a sulfo group as an acid substituent (for example, 2-sulfoethyl, 3-sulfopropyl and 4-sulfobutyl).

The alkyl groups represented by $R_2$ are preferably alkyl groups of 1-8 carbon atoms (for example, methyl, ethyl, n-propyl, t-butyl, and n-heptyl) and these alkyl groups may be substituted with hydroxy group, alkoxy groups such as, for example, methoxy and ethoxy, dialkylamino groups such as, for example, dimethylamino and diethylamino, and the like. The aryl groups represented by $R_2$ are preferably phenyl group and naphthyl group and these aryl groups may be substituted with lower alkyl groups (for example, methyl and ethyl), carboxyl group, sulfo group, cyano group, alkoxy groups (for example, methoxy and ethoxy), alkoxycarbonyl groups (for example, ethoxycarbonyl group), halogen atoms (for example, chlorine atom and bromine atom), carbamoyl group, sulfamoyl group, substituted amino groups (for example, dimethylamino and diethylamino), and the like. The saturated hydrocarbon rings represented by Y and formed together with the carbon atom on the 3-position of the pyrrole ring having Z are preferably 4–7 membered hydrocarbon rings (for example, cyclobutane, cyclopentane, cyclohexane, and cycloheptane) and the saturated heterocyclic rings are preferably tetrahydropyran and others.

The benzo condensed ring and naphtho condensed ring represented by Z may contain the substituents as mentioned for $R_2$. Anions represented by $X\ominus$ include, for example, halogen ions (for example, Br and I), p-toluenesulfonic acid ion and ethylsulfuric acid ion. The dyes represented by the formula (I) have at least one, preferably 2–4 acid substituents (for example, sulfo group and carboxy group). The acid substituents may be in the form of salts of alkali metals such as Na and K, ammonium salts, and organic ammonium salts such as triethylamine, tributylamine and pyridine.

While the dyes of the present invention represented by the above formula have a high molecular extinction coefficient in the desired wavelength region, they have substantially no unnecessary side absorptions in other wavelength region and besides, cause no adverse effects on photographic characteristics such as reduction in sensitivity and fogging and can sufficiently exhibit anti-irradiation and anti-halation effects and filter effect with a small addition amount.

Moreover, after development treatment, the dyes are completely and rapidly dissolved away from the light-sensitive material or decolored and hence there occur no retention of the dye in the finished photographic images, no color stain due to recoloration of the decolored dye and no redying due to coloration of development processing solution.

Furthermore, the dyes of the present invention have the advantages that they undergo no change such as discoloration during preparation of dye solution and no influence by external conditions such as wet heat during preparation of photographic lightsensitive emulsion and subsequent storage and thus they are stable.

Furthermore, the dyes of the present invention result in no increase of viscosity when added to the coating composition (for photographic emulsion) and cause no failure in coating.

Nonlimiting examples of the dyes represented by the formula (I) are shown below.

Dye 1

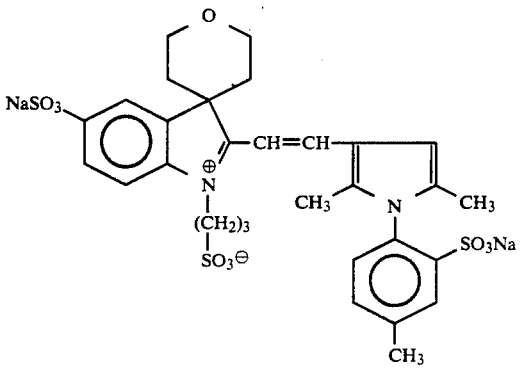

Dye 2

-continued

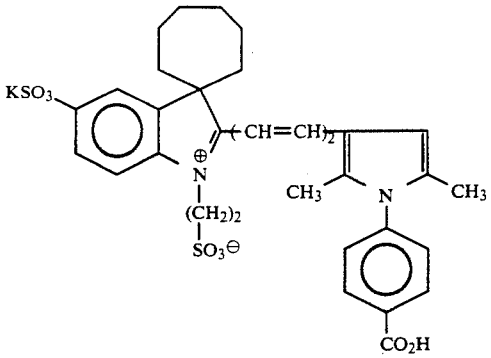

Dye 3

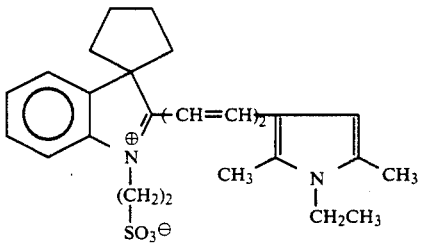

Dye 4

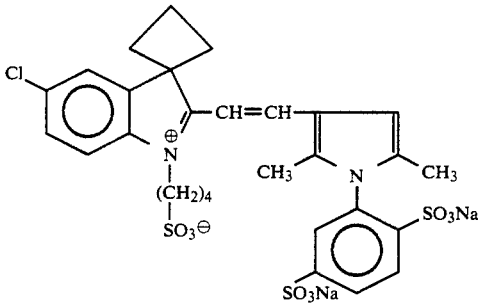

Dye 5

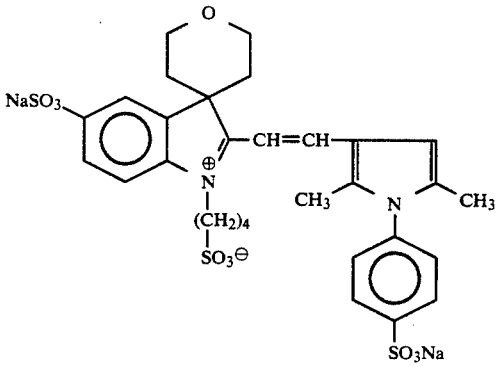

Dye 6

-continued
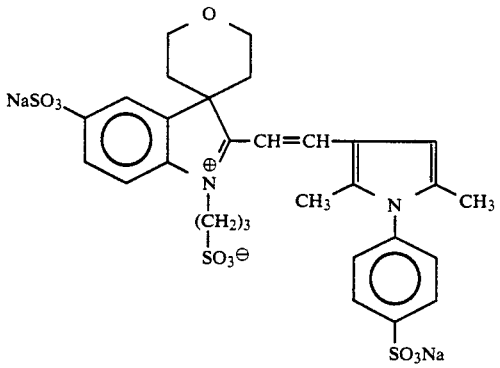
Dye 7
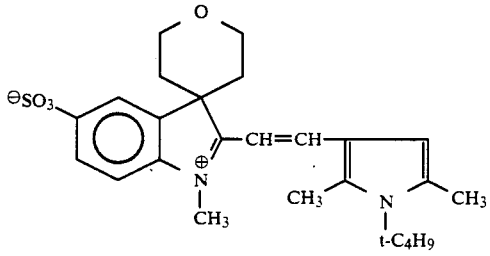
Dye 8
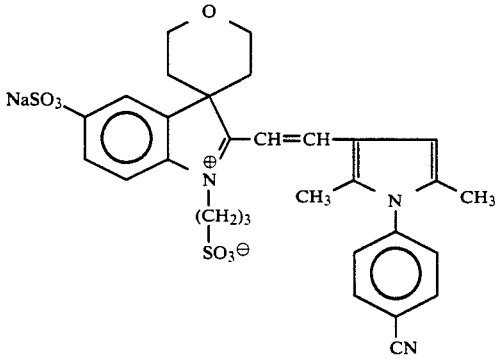
Dye 9
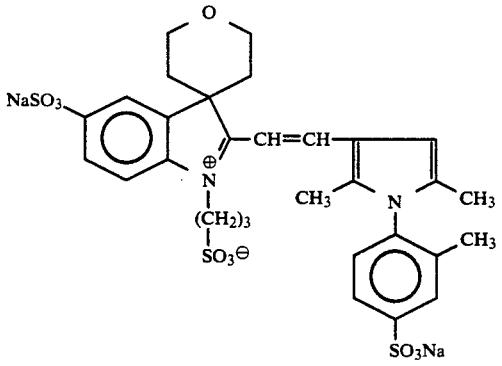
Dye 10
-continued
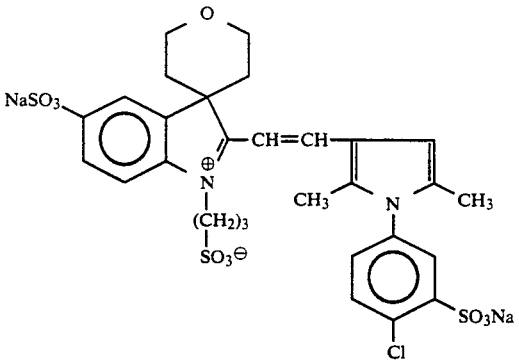
Dye 11
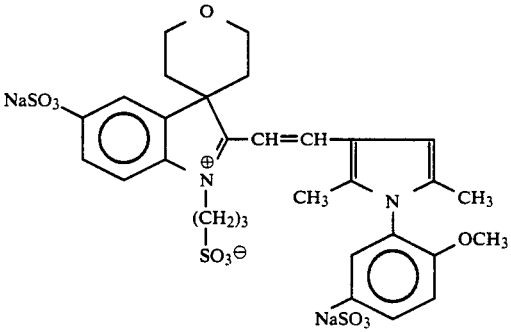
Dye 12
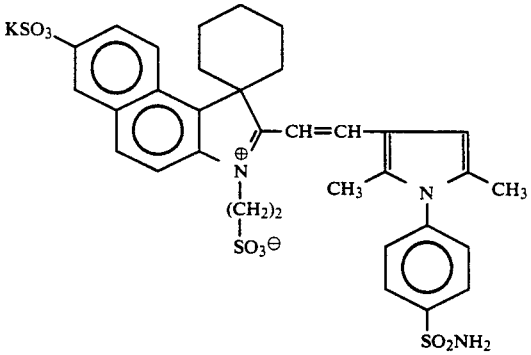
Dye 13
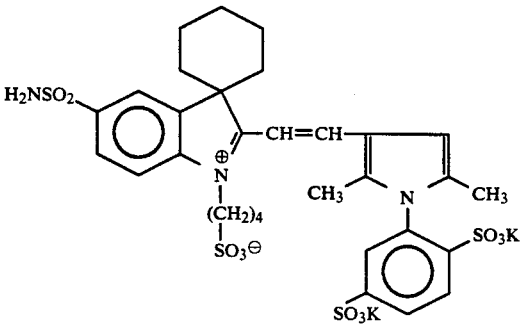
Dye 14

-continued

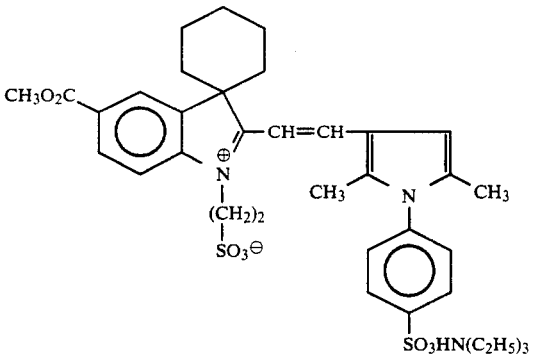

Dye 15

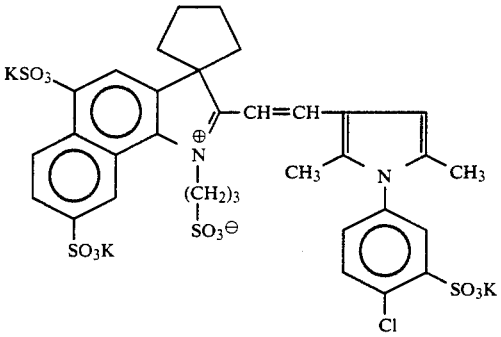

Dye 16

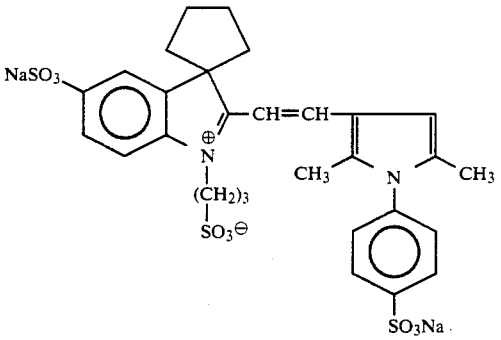

Dye 17

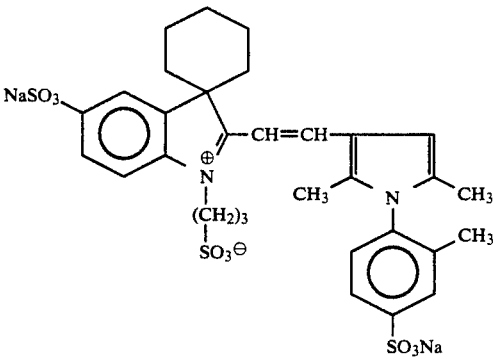

Dye 18

-continued

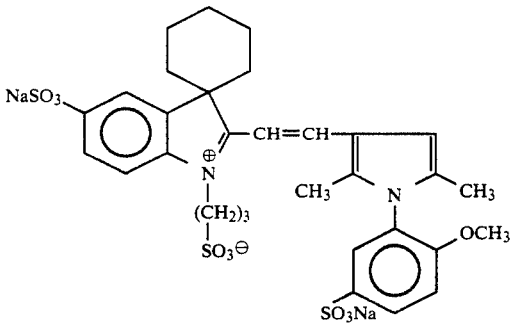

Dye 19

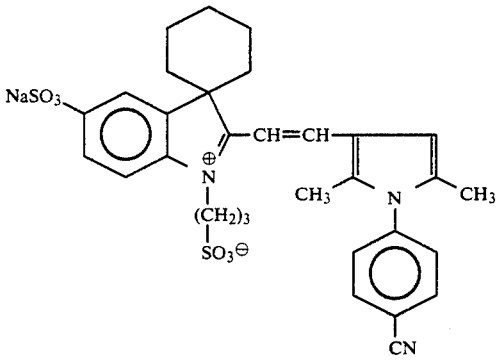

Dye 20

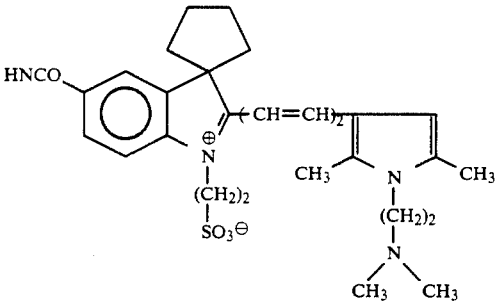

Dye 21

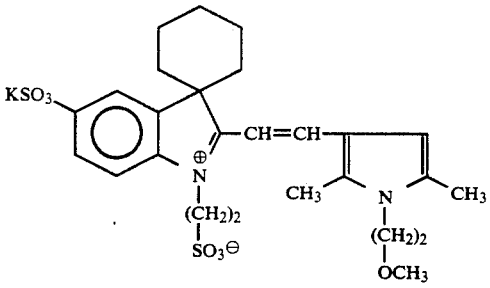

Synthesis example of the dyes of the present invention is shown below.

Synthesis of dye 1:

35 ml of acetic acid and 35 mg of acetic anhydride were added to 1.90 g of 3-formyl-2,5-dimethyl-1-(4'-methyl-2'-sulfophenyl)pyrrole sodium salt and 3.03 g of anhydro-2-methyl-5-sulfo-1-(3'-sulfopropyl)spiro-[3H-indolium-3,4'-tetrahydropyran]hydroxide triethylammonium, followed by stirring for 1 hour with heating at 90° C. After leaving the mixture for cooling, acetic acid and acetic anhydride were distilled off under reduced pressure and the residue was dissolved in 30 ml of methanol and 1.65 g of sodium acetate was added to the solution, followed by refluxing under heating for 10 minutes. Methanol was distilled off under reduced pressure and the residue was subjected to isolation by silica gel chromatograph (developer chloroform/methanol=2/1) to obtain 2.10 g of the desired product.

m.p.: 300° or higher $\lambda_{max}^{H2O}$: 485 nm

Other dyes represented by the formula (I) can also be readily synthesized in accordance with the above synthesis example.

The dyes represented by the above formula are added to silver halide photographic emulsion or protective colloid solution and this can be carried out by adding them as an aqueous solution or as a solution in methanol, ethanol, cellosolves, glycols, dimethylformamide, dimethyl sulfoxide, pyridine, or the like or as a mixed solution in water and the organic solvent to the emulsion layer, backcoat layer, subbing layer, intermediate layer, and ultraviolet absorbing layer to contain them therein.

Amount of these dyes used varies depending on the photographic layer in which they are contained, but usually is 5-1000 mg/m$^2$ of the lightsensitive material.

Silver halide emulsions in which the dyes of the present invention are used include, for example, silver chloride, silver bromide, silver chlorobromide, silver iodobromide and silver chloroiodobromide.

The silver halide photographic emulsions in which the dyes of the present invention are used may be subjected to spectral sensitization with cyanine dyes and merocyanine dyes which are customarily used. Moreover, the emulsions may contain additives such as basic mordants, e.g., polymers containing amino group or ammonium group, stabilizers and precursors thereof, surface active agents, hardeners, ultraviolet absorbers, fluorescent brighteners, and developing agents and precursors thereof. When the silver halide emulsions are used for color lightsensitive materials, they may contain color couplers and dispersants thereof.

As the protective colloids for the silver halide emulsions, there may be added, in addition to gelatin, gelatin derivatives such as phthalated gelatin and malonated gelatin, water-soluble polymers such as polyvinyl alcohol and polyvinylpyrrolidone, plasticizers for dimensional stability and latex polymers.

The silver halide photographic emulsion in which the dye of the present invention is used can be coated on supports such as baryta papers, resin-coated papers, synthetic papers, and natural or synthetic polymer films such as cellulose triacetate and polyester types.

The present invention will be explained in more detail by the following examples.

EXAMPLE 1

1.55 g of gelatin was added to 25 ml of water to swell the gelatin, followed by heating at 40° C. to dissolve the gelatin. To the resulting gelatin solution were added each of aqueous solutions ($2.0\times10^{-4}$ mol/2.0 ml water) of the dyes of the present invention and the comparative dyes mentioned hereinafter and a hardener and a surface active agent and further, water was added to make up totally 40 ml. Then, each of these colored solutions was coated on a subbed polyester film base at a coating amount of 80 g/m$^2$ and heated at 40° C. for 24 hours. This coated film was cut to a rectangle of $8.0\times11.5$ cm$^2$, which was employed as a sample. This sample was dipped in D-72 developer of 30.0° C. for 5 seconds and 15 seconds and washed in running water for 10 seconds. Then, the sample was put between filter papers to absorb water drops on the sample and dried to obtain a processed sample. Optical density and change in the density of the above sample and the processed sample at λmax in 400-800 nm were measured by two wavelengths/double beam automatic recording spectrophotometer (UV-3000) manufactured by Shimadzu Seisakusho Ltd. The results are shown in Table 1.

Comparative dye A

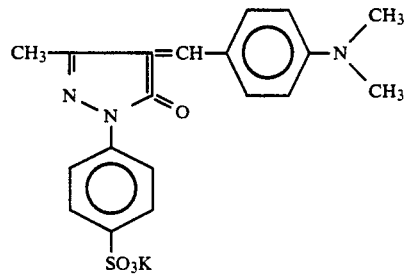

Comparative dye B

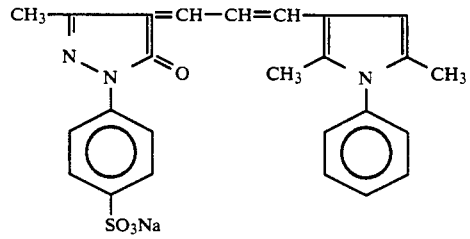

Comparative dye C

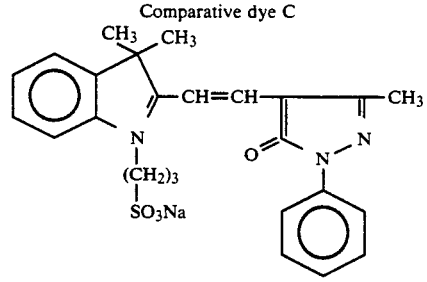

TABLE 1

| Sample | Dye | Absorbance at λmax before processing | Decoloration rate (%) 5 sec | Decoloration rate (%) 15 sec |
|---|---|---|---|---|
| 1 | 1 | 1.57 | 100.0 | 100.0 |
| 2 | 3 | 1.48 | 98.5 | 100.0 |
| 3 | 5 | 1.55 | 100.0 | 100.0 |
| 4 | 6 | 1.61 | 100.0 | 100.0 |
| 5 | 7 | 1.49 | 100.0 | 100.0 |
| 6 | 8 | 1.75 | 100.0 | 100.0 |
| 7 | 10 | 1.70 | 100.0 | 100.0 |
| 8 | 14 | 1.68 | 100.0 | 100.0 |
| 9 | 18 | 1.62 | 100.0 | 100.0 |
| 10 | 19 | 1.80 | 100.0 | 100.0 |
| 11 | A | 1.45 | 96.5 | 99.0 |
| 12 | B | 1.62 | 90.0 | 92.0 |
| 13 | C | 1.60 | 88.0 | 91.0 |

Decoloration rate (%) = $\frac{a-b}{a}\times100$ a: Absorbance of the unprocessed sample at λmax.

b: Absorbance of the processed sample at λmax.

As is clear from Table 1, the dyes of the present invention are superior in optical density before processed and decoration rate after processed as compared with the comparative dyes A-C.

EXAMPLE 2

A 1% aqueous solution of the dye was added to a 10% aqueous gelatin solution so as to show an optical density of 1.0 when coated at a coating amount of 80 g/m$^2$ and 5 ml of a 10% aqueous saponin solution and 1.5 ml of a 10% formalin were added per 150 ml of the aqueous gelatin solution to obtain a colored aqueous gelatin solution. In the same manner as in Example 1, a hardened coat layer of 1.0 in optical density was formed using the resulting colored aqueous gelatin solution. A pure silver bromide emulsion was coated on the coat layer and was developed with a developer of the following composition at 20° C. for 90 seconds, then fixed and dried in accordance with the usual methods.

Optical density of the resulting unprocessed films was measured in the same manner as in Example 1. Density of the processed samples containing the dyes of the present invention was all 0.02 (with density of the base being 0.02).

| Composition of the developer | |
|---|---|
| Metol | 3 g |
| Sodium sulfite | 45 g |
| Hydroquinone | 12 g |
| Sodium carbonate (monohydrate) | 80 g |
| Potassium bromide | 2 g |
| Water to make up totally 1 liter. | |

Furthermore, the samples containing the dyes of the present invention showed no changes with time such as discoloration and fading in color during preparation of the aqueous solution and the emulsions and storage, and besides underwent no adverse effects on photographic characteristics such as fogging and reduction in sensitivity and had excellent anti-halation effect.

What is claimed is:

1. A silver halide photographic lightsensitive element which comprises a support and at least one hydrophilic colloid layer including a silver halide emulsion layer, wherein said hydrophilic colloid layer contains 5-1000 mg/m$^2$ of at least one dye represented by the following formula (I):

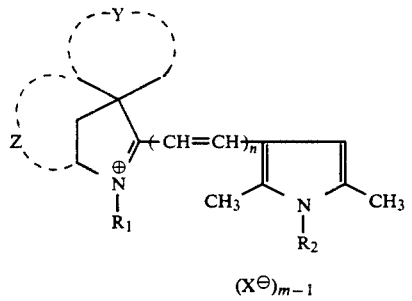

(I)

(wherein $R_1$ represents an alkyl group, $R_2$ represents an alkyl group or an aryl group, Y represents a group of atoms necessary to form a saturated hydrocarbon ring or a saturated heterocyclic ring together with the carbon atom on the 3-position of pyrrole ring having Z, Z represents a group of atom necessary to form a benzo condensed ring or a naphtho condensed ring, n represents 1 or 2, m represents 1 or 2 and m is 1 when the dye forms an inner salt, and X⊖ represents an anion, with a proviso that a molecule of the dye has at least one acid substituent.

2. A silver halide photographic lightsensitive element according to claim 1, wherein the alkyl group of $R_1$ in the formula (I) is a lower alkyl group of 1-5 carbon atoms which may have a substituent.

3. A silver halide photographic lightsensitive element according to claim 1, wherein the alkyl group of $R_2$ in the formula (I) is an alkyl group of 1-8 carbon atoms which may have a substituent.

4. A silver halide photographic lightsensitive element according to claim 1 wherein the aryl group in the formula (I) is a phenyl or naphthyl group which may have a substituent.

5. A silver halide photographic lightsensitive element according to claim 1, wherein the saturated hydrocarbon ring formed by Y is a 4-7 membered hydrocarbon ring and the saturated heterocyclic ring is tetrahydropyran.

6. A silver halide photographic lightsensitive element according to claim 1, wherein the acid substituent is in the form of an alkali metal salt, an ammonium salt or an organic ammonium salt.

* * * * *